US008403679B2

(12) United States Patent
Berard et al.

(10) Patent No.: US 8,403,679 B2
(45) Date of Patent: Mar. 26, 2013

(54) HIGH VOLTAGE SWIVEL WITH STACKED RING-SHAPED CONDUCTOR ASSEMBLIES

(75) Inventors: Maxime Baptiste Berard, Cap d'Ail (FR); Eric Barrabino, Monaco (MC); Philippe Albert Christian Menardo, Beaulieu-sur-Mer (FR); Jean-Pierre Queau, Nice (FR); Benjamin Passieux, Saint Laurent du Var (FR)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 13/132,174

(22) PCT Filed: Dec. 1, 2009

(86) PCT No.: PCT/EP2009/066143

§ 371 (c)(1),
(2), (4) Date: Jun. 1, 2011

(87) PCT Pub. No.: WO2010/063715

PCT Pub. Date: Jun. 10, 2010

(65) Prior Publication Data

US 2011/0237089 A1 Sep. 29, 2011

(30) Foreign Application Priority Data

Dec. 1, 2008 (EP) ..... 08170397
Jan. 13, 2009 (EP) ..... 09150434

(51) Int. Cl.
*H01R 39/00* (2006.01)

(52) U.S. Cl. ..... 439/24

(58) Field of Classification Search ..... 439/23, 439/24, 25, 19

See application file for complete search history.

(56) References Cited

U.S. PATENT DOCUMENTS 4,252,388 A 2/1981 Brady
6,612,847 B2 * 9/2003 Canizales, Jr. ..... 439/17
7,137,822 B1 * 11/2006 Longmire et al. ..... 439/24

FOREIGN PATENT DOCUMENTS

WO 2007/068278 A1 6/2007

OTHER PUBLICATIONS

International Search Report, dated May 21, 2010, from corresponding PCT application.

* cited by examiner

FOREIGN PATENT DOCUMENTS

*Primary Examiner* — Phuong Dinh
(74) *Attorney, Agent, or Firm* — Young & Thompson

(57) ABSTRACT

A high voltage swivel including an inner and an outer body, each body having at least a first and a second ring-shaped conductor element, the conductor elements including two spaced-apart end faces and a curved contact surface, the elements being mutually interconnected at opposing end faces via insulating members at axially spaced-apart positions, the inner and outer bodies being coaxial around a longitudinal axis, the contact surface of each inner conductor element being adjacent to and in electrical contact with an opposed contact surface of a corresponding outer conductor element, the inner and outer bodies being rotatable relative to one another around the longitudinal axis, each conductor element of the inner and outer body connected to a voltage line extending to an input terminal or an output terminal, the insulator members interconnecting the conductor elements situated at a mutual distance in the circumferential direction of the conductor element, the interconnected conductor elements of the inner and the outer body each being supported by a respective support member to form integral units such that the inner and outer bodies are adapted to be mutually decoupled or attached by relative displacement of the integral units in the direction of the longitudinal axis.

20 Claims, 9 Drawing Sheets

HIGH VOLTAGE SWIVEL WITH STACKED RING-SHAPED CONDUCTOR ASSEMBLIES

FIELD OF THE INVENTION

The invention relates to a high voltage swivel comprising an inner and an outer body, each body having at least a first and a second ring-shaped conductor element, the conductor elements comprising two spaced-apart end faces and a curved contact surface, the elements being mutually interconnected at opposing end faces via insulating members at axially spaced-apart positions, the inner and outer bodies being coaxial around a longitudinal axis, the contact surface of each inner conductor element being adjacent to and in electrical contact with an opposed contact surface of a corresponding outer conductor element, the inner and outer bodies being rotatable relative to one another around the longitudinal axis, wherein each conductor element of the inner and outer body is connected to a voltage line extending to an input terminal or an output terminal.

BACKGROUND OF THE INVENTION

Such a high voltage swivel is known from U.S. Pat. No. 7,137,822 in the name of the applicant. The known swivel is a high voltage swivel for offshore applications, for instance for distributing electrical power, that is generated on a weathervaning Floating Production, Storage and Offloading vessel (FPSO)—which FPSO is anchored to the sea bed via a turret—to a sub sea power cable. Geostationary hydrocarbon risers extend upwards from a well head to a power plant on the vessel, in which the hydrocarbons are converted into electrical energy. The electrical connection of the rotating vessel to the stationary sub sea power cable leading to shore is achieved by the high voltage swivel in which the stator is connected, via the geostationary swivel part on the vessel, to the sub sea power cable and the rotor is connected to the power plant on the vessel.

The conductors of the inner and outer bodies of the known high voltage swivel are embedded in solid annular insulator rings which fully surround the conductors, apart from their contact areas. This results in a very good electrical insulation and the use of a solid insulator in stead of air or a dielectric oil allows a compact design and operation at relatively high voltages. The conductors comprise concentric rings each having an annular metal contact surface via which the inner and outer conductors make full contact, such that the mechanical forces and electrodynamic forces as well as the currents are distributed evenly over the full circumference.

The known swivel has the disadvantage that there is a risk of short circuits after the system has been in operational use for a while and the conductors start to show some wear. When debris originating from wear get in the narrow space between the conductors and the insulating rings, short circuits can be created, causing the swivel to malfunction. Upon wear of the spring elements at the contact surfaces of the annular conductors, the solid insulator rings and conductors of the swivel need to be dismantled in order to obtain access to the electrodes.

It therefore is an object of the invention to reduce the risk of malfunctioning of the swivel due to debris. It is a further object of the invention to reduce the amount of wear of the conductors and the amount of debris, while obtaining a good electrical contact. It is again an object of the invention to provide a swivel of reduced weight, in which the inner and outer annular conductors are accurately aligned and can take up large mechanical and electrodynamic loads, especially under offshore conditions. The swivel should allow easy handling during assembly and disassembly for inspection or replacement purposes.

SUMMARY OF THE INVENTION

Hereto a high voltage swivel according to the invention is characterised in that the insulator members interconnecting the conductor elements are situated at a mutual distance in the circumferential direction of the conductor element, the interconnected conductor elements of the inner and the outer body each being supported by a respective support member to form integral units such that the inner and outer bodies are adapted to be mutually decoupled or attached by relative displacement of the integral units in the direction of the longitudinal axis The open area between the conductors in the axial direction, and the open area between adjacent insulator members in the circumferential direction of the conductor elements result in an open cage-like construction of the inner and outer conductor stacks. Insulating oil can freely flow through the open stacked conductor configuration which prevents occasional debris originating from wear to become trapped, as such debris can be easily removed from the open area without causing short circuits by bridging the space between the conductors. By constructing an open inner and an outer stack of at least two spaced-apart annular conductors, the conductors can be mechanically aligned in a stable manner, and can be easily assembled or disassembled for inspection or repair. The open conductor stacks according to the invention provide a stable and light-weight swivel construction which can withstand large electrodynamic forces and which is especially suitable to remain mechanically aligned under offshore conditions.

As the inner and outer conductor stacks each form an integral unit, handling upon installation or replacement is facilitated. The conductors of the inner and outer bodies can be aligned easily by accurate mutual alignment of the units along the longitudinal axis. Disassembling the inner and outer bodies is relatively easy as they can be separated by pulling the units apart in the axial direction.

From U.S. Pat. No. 4,252,388 a high voltage swivel is known, where the inner body comprises a stack of conductors, dielectric support spacers and washer-like dielectric barriers. The conductors of the outer body are provided by a single or a low number of carbon brushes, each contacting a conductive ring of the inner body at a single position along its circumference. This causes considerable wear and hence contamination from the resulting debris. Moreover, it gives a single, or a low number of, narrow current paths from inner to outer element, which poses limitations on the maximum voltage to be transmitted by the swivel. Furthermore, the mechanical stiffness of the known carbon support brushes is relatively low such that electrical contact is not always optimal and the maximum current passable through the carbon brushes is limited. Upon assembly and disassembly, the outer conductors all need to be individually installed and replaced, which complicates handling of the known swivel parts.

In one embodiment, the support member comprises a transverse flange extending substantially parallel to the ring-shaped conductor elements. The flanges carrying the conductor stacks can connected to or form a part of a housing containing the conductor elements, and support these elements such that the outer body can rotate relative to the inner body, around the longitudinal axis.

The inner body may comprise along the longitudinal axis a core element carrying at a lower side the transverse flange, a lower conductor element of the inner body being with a lower end face connected to the transverse flange via spaced-apart insulating members.

In order to interconnect the spaced-apart conductor elements of the inner body, the elements may comprise at least one radially inwardly projecting conductor part attached to an inner axial conductor that extends inwardly of the ring-shaped conductor elements in an axial direction to an end part that is situated above or below the topmost or lowermost conductor element of the inner body, which end part is attached to a connector terminal. In this way, the inner axial conductors extend inwardly of the ring shaped conductor elements to an output or input terminal without interfering with the relative rotational movement of the inner and outer ring-shaped conductor elements around the longitudinal axis.

In a similar manner, each conductor element of the outer body may comprise at least one radially outwardly projecting conductor part attached to an outer axial conductor that extends outwardly from the ring-shaped conductor elements in an axial direction to an end part above or below the topmost or lowermost conductor element of the outer body, which end part is attached to a connector terminal. Preferably the connector terminals of the inner and outer body are situated at opposite end parts of the axial conductors, such that sufficient space is available to accommodate the connectors at the end of the power cables that connect to the swivel.

The connector terminals of the inner and/or of the outer body may be axially directed and can be attached along a circular contour on a radial flange. The power cables connected to the stator and rotors part of the swivel in this embodiment extend, at least in the vicinity of the swivel, in the axial direction.

Alternatively, the connector terminals at the end parts of the axial conductors of the inner and/or of the outer body may be radially directed and attached along a contour of a ring-shaped support. In this way, the power cables near the rotor or stator part of the swivel may be oriented in a radial direction.

In one embodiment, radial flange of the inner or outer body is connected to a lower cylindrical housing part, the ring-shaped support of the other body being attached via a rotatable bearing to the lower housing part and to a cover to form a liquid-tight enclosure around the conductor members. Inside the enclosure, a dielectric fluid, such as oil, is accommodated. In a preferred embodiment, the inner and outer bodies are attached to a top cover and to a bottom cover, respectively, which covers are interconnected via an inner cylindrical wall, one of the covers being rotatable relative to the cylindrical wall around the vertical axis, an outer cylindrical wall surrounding the inner wall, which inner wall is provided with apertures and seals that are adapted to open the apertures when a predetermined pressure on the seal is exceeded. In this way, an extra containment compartment is formed for the dielectric fluid by the space between the first and second cylindrical walls, which compartment is only accessible after the seals—for instance formed by burst discs—have been ruptured by a sudden pressure increase, which may be caused by a short-circuit and a sudden increase in pressure due to vaporisation of the dielectric fluid. In this way, the effects of an internal short circuit due to pressure build-up, such as release of explosive gas or projection of hot oil, can be avoided. The internal dimensions of the swivel having an outer containment wall according to the invention, can remain relatively small, as the adverse effects of an internal short circuit are strongly reduced.

In a preferred embodiment of a high voltage swivel, spring plates are fixed to the conductor element at the contact surface of the inner or outer conductor element, arranged side by side, a length direction of the spring plates extending in the circumferential direction of the conductor element. Placing the spring plates, which have a louver like construction, with their length direction in the circumferential direction of the swivel, an equal resistance in both rotational directions is achieved. This results in even force distribution and reduced wear of the spring plates, while good conductive contact is maintained between the inner and outer ring shaped conductor elements at all times.

For improving the ease of construction, the spring plates can be situated on the contact surface of the inner conductor, which is easily accessible. The spring plates may have a length that is smaller than 0.1 preferably smaller than 0.05 times a circumferential length of the conductor contact surface, such that at least 10 sets, preferably at least 20 sets of substantially parallel spring plates can be placed at the contact surface for optimising the electrical conductive contact between inner and outer conductors.

In a further embodiment, the spring plates may be formed in a mounting frame, one of the conductors having at a contact surface a coupling member for engaging with the mounting frame, the mounting frames covering at least a part of the contact surface of the conductor element. The mounting frames with the conductors can be manufactured separately with high accuracy and can be easily mounted on the contact surface of the inner or outer conductor ring.

BRIEF DESCRIPTION OF THE DRAWINGS

Some embodiments of a high voltage swivel according to the invention will by way of non-limiting example be explained in detail with reference to the accompanying drawing. In the drawing.

DETAILED DESCRIPTION OF THE INVENTION

Figure 1:
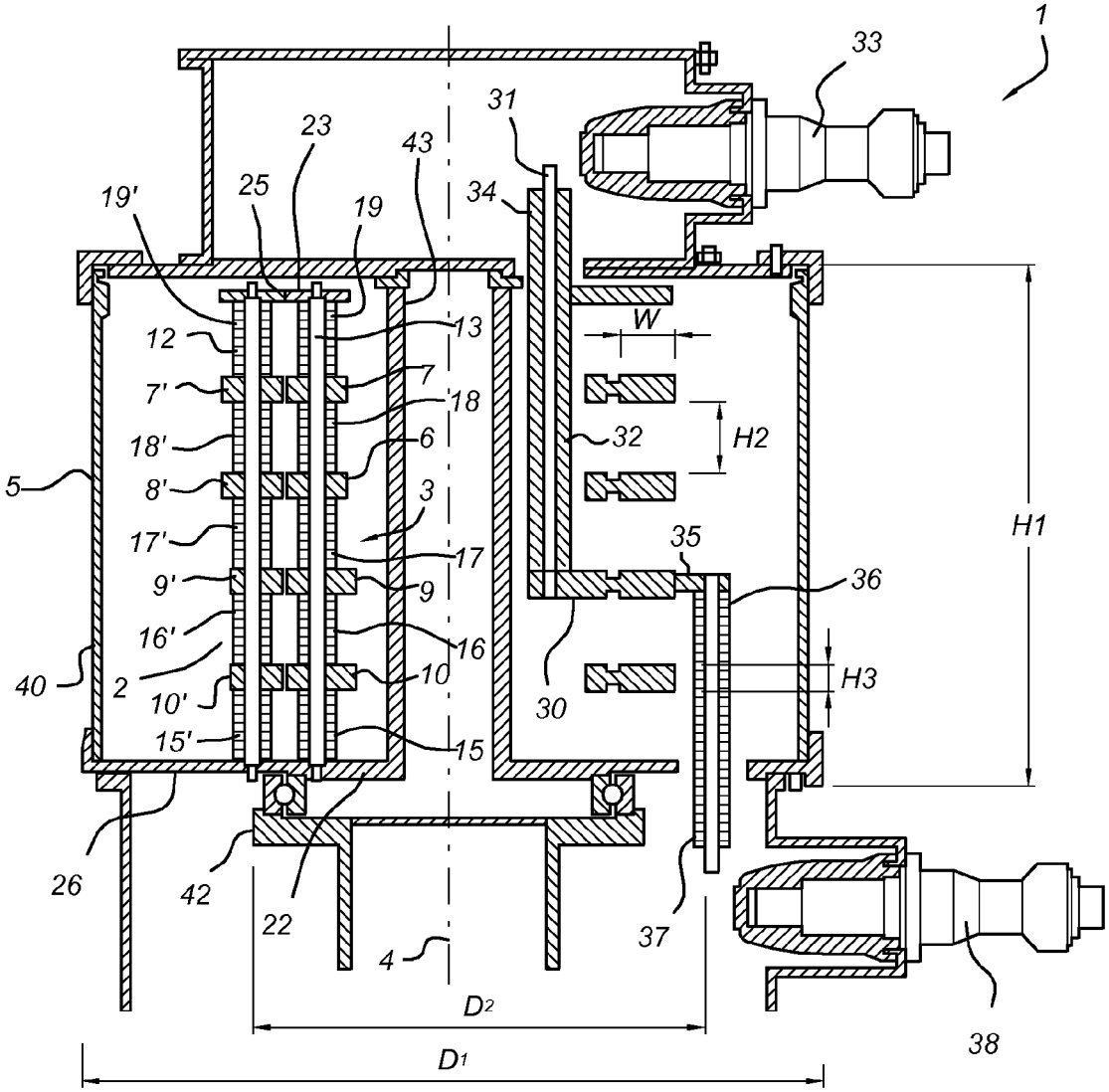
FIG. 1 shows a cross-sectional view of a first embodiment of a high voltage swivel according to the invention.

FIG. 1 shows a high voltage swivel 1 comprising a stationary outer body and a rotatable inner body. The outer and inner bodies are formed by inner and outer conductor stacks 2, 3 that are co-axially aligned around longitudinal axis 4 and are enclosed in a housing 5. The outer and inner stacks 2, 3 are each comprised of four ring-shaped conductor elements 7,7', 8, 8',9,9' and, 10,10', one conductor element for each phase and one for connection to ground voltage level. The conductors elements 7-10 and 7'-10' are provided with aligned holes through which an insulating connecting rod 12, 13 is guided. Around the connecting rods 12, 13, insulating spacers 15, 15',16, 16', 17, 17',18 18', 19, 19' are provided, which abut against end faces 45,45',46,46' (see FIG. 2) of pairs of adjacent conductor elements 7,8; 7',8'; 8,9; 8',9' and 9,10; 9',10' and maintain a predetermined axial distance between these adjacent conductor elements. The lower spacer 15 of the inner conductor stack 3 is connected to a lower support member 22, and the upper spacer 19 is adjacent an upper support member 23. The connecting rod 13 clamps the insulating spacers 15-19 and the ring-shaped conductors 7-10 between the upper and lower support members 22,23 such that the support members, the connecting rods, the insulating spacers and the ring-shaped conductors form an integral unit. The same holds for the outer conductor stack 2 wherein the ring-shaped conductors 7'-10' are interconnected via the outer connecting rod 12, and the insulating spacers 15'-19' that are clamped between upper support member 25 and lower support member 26.

Each of the inner conductor elements 7-10 comprises a conductor part 30 forming a radial extension, which conductor part supports an inner axial conductor 31 that is provided with an insulating sheath 32. The axial conductor 31 extends within the inner ring-shaped conductor elements 7-10 and has an end part 34 situated above the topmost conductor, the closed contour of elements 19,19', which end part 34 is attached to a radially oriented connector terminal 33. The outer conductor elements 7'-10' comprise a radially oriented outer conductor part 35 that is connected to outer axial conductor 36 having a lower end 37 situated below the lowermost ring-shaped conductor elements 10,10'. The outer axial conductor 36 extends with a lower end 37 below the lowermost ring-shaped conductor element 10' and is attached to a connector terminal 38 which is radially oriented. For each inner ring-shaped conductor element 7-10 and for each outer ring-shaped conductor element 7'-10' two inner and two outer axial conductors 32,36 as well as two connector terminals 33,38 are provided for an even distribution of input and output currents.

The housing 5 of the high voltage swivel provides a fluid-tight containment of dielectric oil. An outer housing part 40, supporting the outer conductor stack 2 is connected via an axial-radial bearing 42 to an inner housing part 43 supporting the inner conductor stack 3.

After disconnecting the bearing 42 and detaching the axial conductors 32, 36 from their respective connector terminals 33, 38, the outer conductor stack 2 can be lifted in the direction of the longitudinal axis 4, to disconnect the conductor stacks 2,3 for maintenance or repair. The open space between the conductor elements 7-10;7'-10' and between adjacent insulating spacers 15,15';16,16';17,17' and 18,18' that are situated at the same axial positions, leaves free access for dielectric oil circulation and prevents debris from being trapped between pairs of adjacent ring-shaped conductor elements 7,7'-10,10' and hence avoids short-circuits from being formed. The free transport of debris by the oil by natural convection ensures that debris are not trapped at a fixed position such that chances of a short circuit being caused by these debris is strongly reduced. Also heat, generated upon current transfer between the inner and the outer conductor stacks, is transported by convection to the surrounding oil and by the oil to the metal housing 5. Heat transported to the housing 5 will be transferred to the ambient air by convection. The oil inside the housing 5 is not actively circulated.

Figure 2:
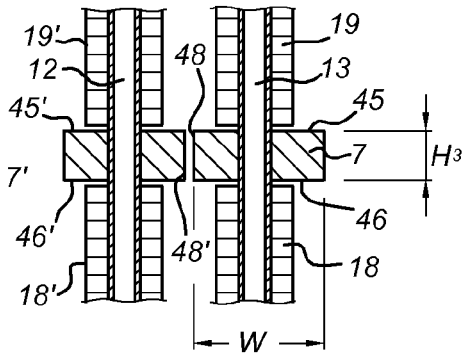
FIG. 2 shows a detail of the conductor elements of FIG. 1 on an enlarged scale.

The height $H_1$ of the swivel 1 may lie between 0.7 m and 2.0 m, for instance about 1.5 m. The axial distance $H_2$ between adjacent ring-shaped conductor elements can lie between 6 cm and 25 cm, for instance 15 cm. A thickness $H_3$ of the ring shaped conductor elements 7,7'-10,10' can range from 3 cm to 10 cm, for instance 5 cm. The width W of the conductor elements may lie between 10 cm and 20 cm, for instance 15 cm. The outer diameter D1 of the swivel is for instance between 1.5 m and 2.5 m, for instance 2 m, whereas the outside diameter D2 of the outer conductor stack 2 can be between 1 m and 2 m, for instance 1.3 m FIG. 2 shows an enlarged detail of two adjacent conductor elements 7,7'. The insulating spacers 19,19'; 18,18' abut against upper end faces 45, 45' and lower end faces 46, 46' of the conductor elements 7,7'. Each conductor element 7,7' has a curved contact surface 48,48' which contact surfaces are placed in opposed sliding relationship to transfer currents from one conductor element to the other.

The inner and outer conductor stacks 2,3 constitute a stable and robust structure in which mechanical forces and electro dynamic forces, as well as the currents are distributed evenly over the full circumference of the rings-shaped conductor elements. At the same time, full rotational freedom is provided between the rotating swivel part (e.g. the outer stack 2) that is fixed to the floating offshore structure, which structure may comprise an offshore weathervaning power generating unit, such as a wind turbine unit, an FPSO and the like, and the geostationary swivel part (e.g. the inner conductor stack 3) that may be connected to a sub-sea power cable.

Figure 3:
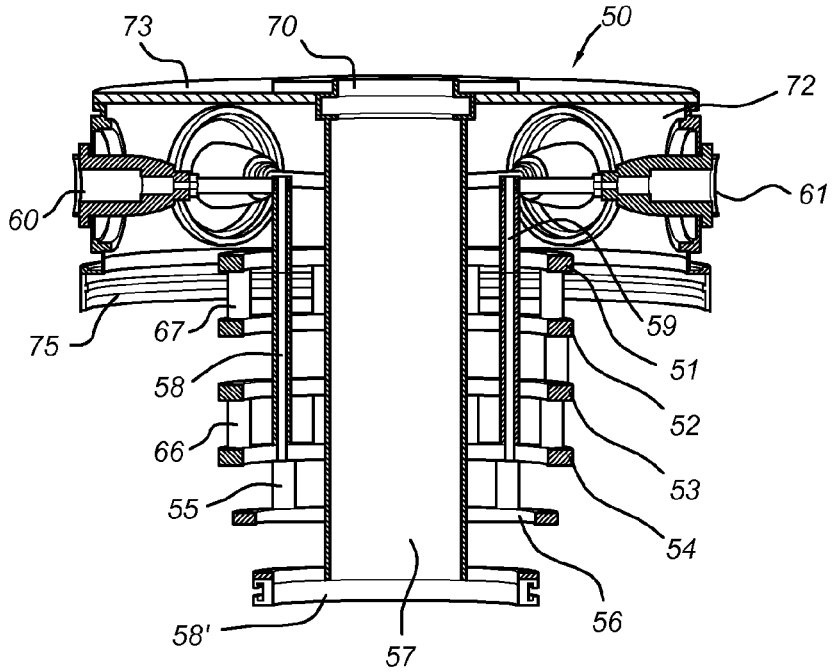
FIG. 3 shows a cross-sectional view of an inner conductor stack of a second embodiment of a high voltage swivel according to the invention.

FIG. 3 shows an embodiment wherein the inner conductor stack forms an integral unit 50 having four interconnected ring-shaped conductor elements 51,52,53 and 54. The conductor elements 51-54 are interconnected by the insulating spacers 55, 66, 67 that are distributed along the circumference of the conductor elements. The lower conductor element 54 is supported via lowermost insulating spacers 55 onto a transverse flange 56 near a lower end 58' of a central support member 57. Two inner axial conductors 58, 59 extend upwardly, along the inside of the ring-shaped conductor elements 51-54 from the lower conductor element 54 to connector terminals 60, 61. The same applies for each conductor element 51 and 53, such that in total six connector terminals are provided for the three conductor elements 51, 53 and 54. The conductor element 52 defines a ground voltage level, and is coupled to a single ground connector terminal 62 (see FIG. 4).

Figure 4:
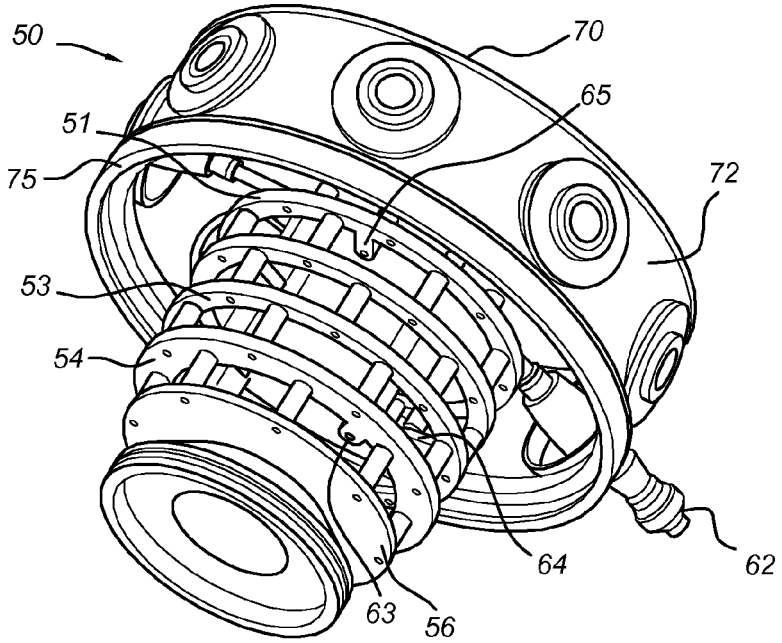
FIG. 4 shows a perspective view of the inner conductor stack of FIG. 3.

As can be clearly seen from FIG. 4, the inner axial conductors 58,59 are connected to the conductor element 54 via the radially inwardly projecting conductor part 63. The conductor parts 64, 65 of the conductor elements 51 and 53 are also indicated in FIG. 4. Near an upper end 70 the connector terminals 60, 61, 62 are mounted in a cylindrical support 72. The cylindrical support 72 forms part of the outer housing and is at its upper edge connected to a top wall 73. The top wall 73 is also connected to an upper end of the central support member 57 to form a rigid integral unit 50. Along a lower edge of the cylindrical support 72, a bearing 75 is attached for rotatably connecting to a lower housing part of the swivel.

Figure 5:
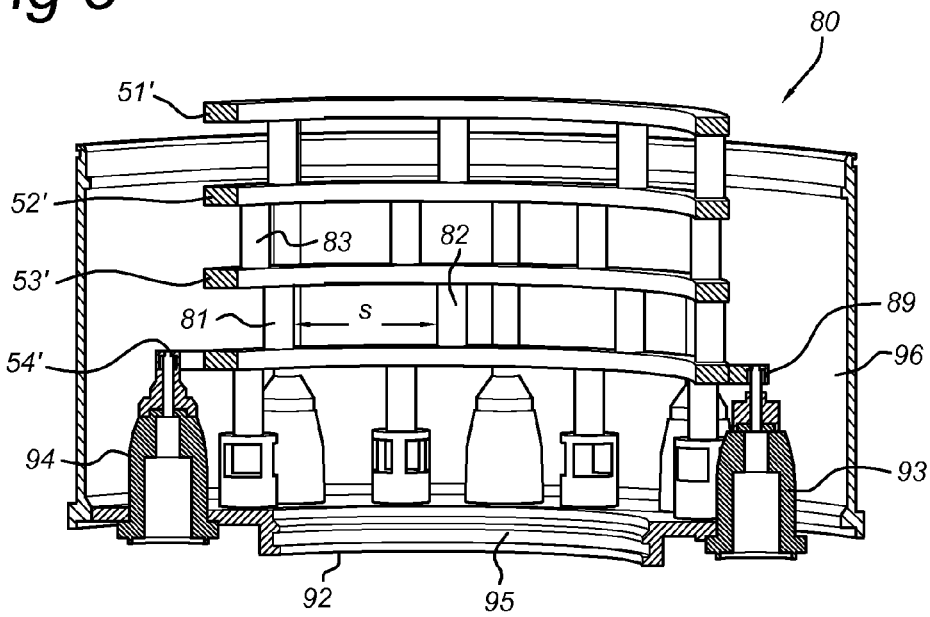
FIG. 5 shows a cross-sectional view of an outer conductor stack of the second embodiment of a high voltage swivel according to the invention for cooperation with the inner conductor stack of FIGS. 3 and 4.
Figure 6:
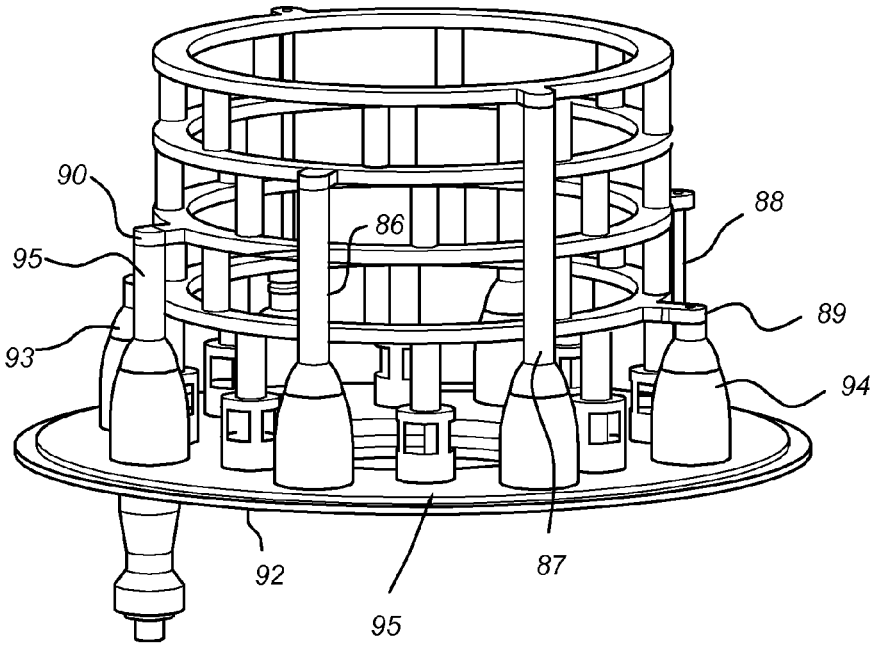
FIG. 6 shows a perspective view of the outer conductor stack of FIG. 5.

FIG. 5 shows the outer conductor stack wherein an integral unit 80 is formed by four outer ring-shaped conductor elements 51',52',53' and 54'. The conductor elements 51'-54' are interconnected via the insulating spacers 81,82,83. Adjacent spacers 81,82 are placed at a relatively large mutual distance S of for instance 40 cm such that a largely open configuration of the stacked conductor elements 51'-54' is obtained. As can be seen from FIG. 6, the outer conductor elements 51'-54' are coupled to outer axial conductors 85,86,87,88, wherein conductor 88 is shown without the outer insulating sheath. The conductors 85-88 are coupled to outer conductor parts 89,90 which project from the conductor elements 51'-54' in a radial direction. Near the lower end 92, the outer axial conductors 85-88 are coupled to connector terminals 93,94 extending in an axial direction and being mounted in a lower ring-shaped support 95. The lower ring-shaped support 95 is with its edge connected to a lower cylindrical wall part 96 of the outer housing 101.

Figure 7:
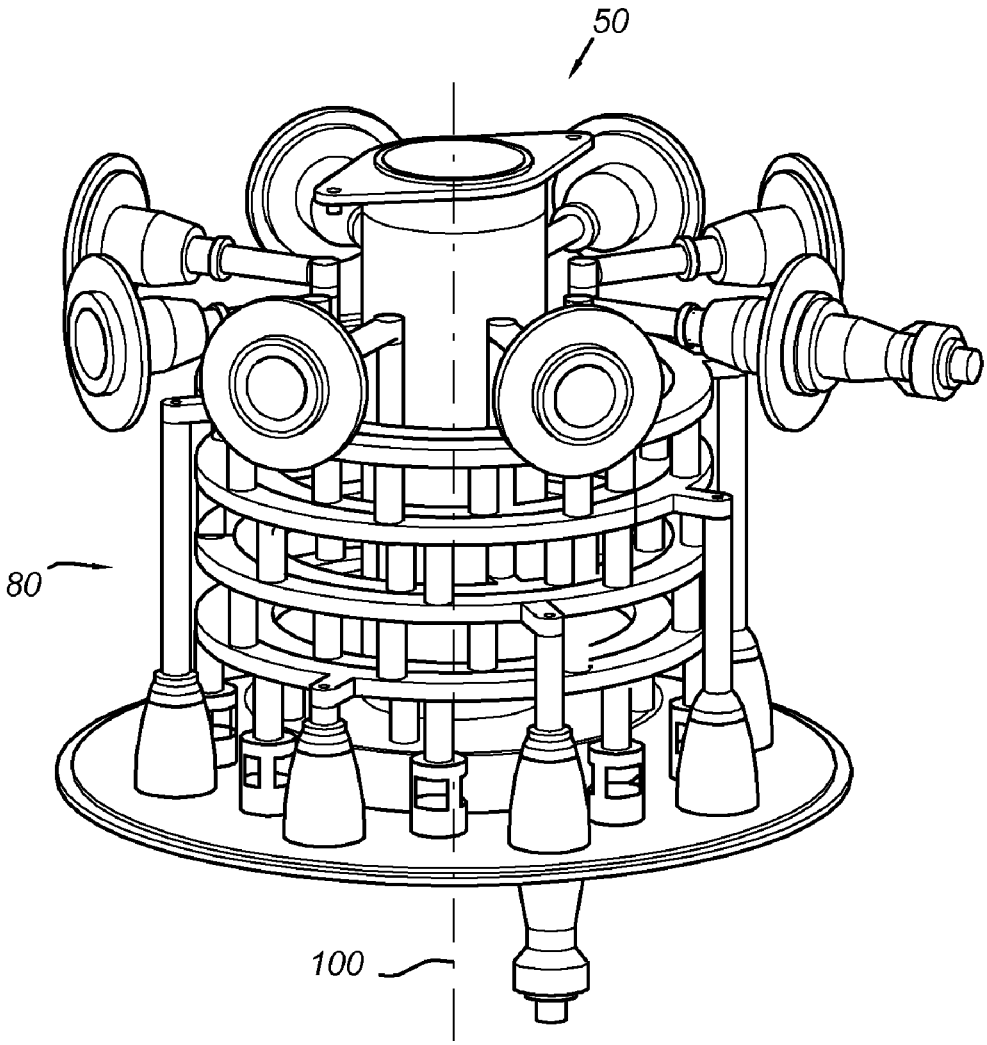
FIG. 7 shows a perspective view of a high voltage swivel, with the inner and outer conductor stacks of FIG. 3-6 in an assembled configuration.
Figure 8:
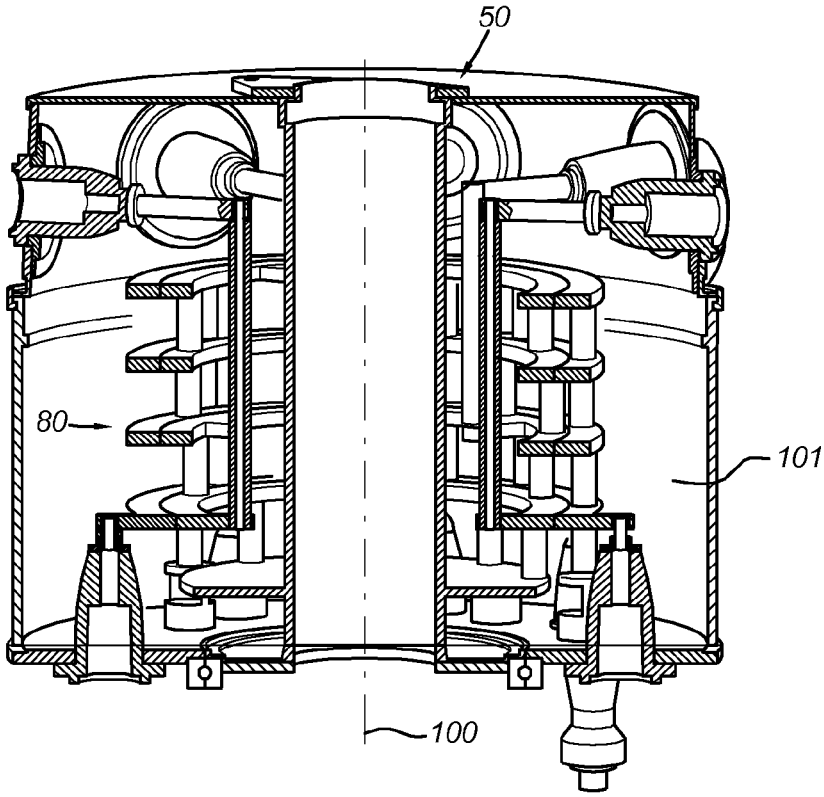
FIG. 8 shows a cross-sectional view of the high voltage swivel of FIG. 7.

FIG. 7 shows a perspective view of the integral units 50 and 80 of the inner and outer conductor stacks in the assembled configuration, coaxially aligned around the longitudinal centre line 100, whereas FIG. 8 shows the assembled integral units 50, 80 in cross-sectional view. The outer housing 101 has only schematically been indicated in FIG. 8.

Figure 9:
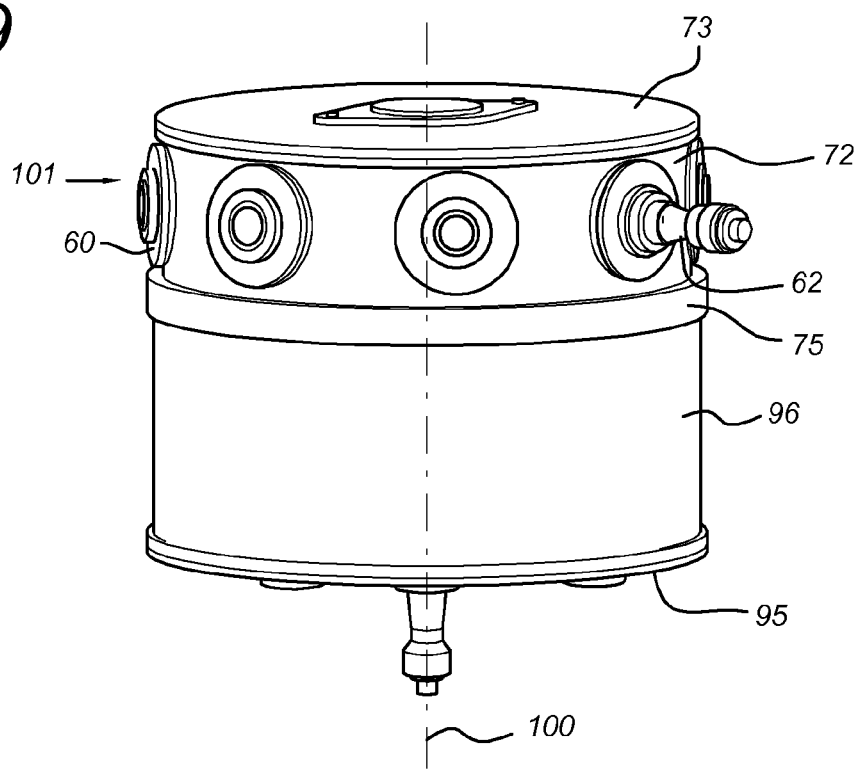
FIG. 9 shows a perspective view of the high voltage swivel outer housing.

FIG. 9 shows the outer housing 101 of the swivel providing a fluid tight containment of the insulating oil that surrounds the inner and outer conductor stacks with the cylindrical support 72 rotatably attached to lower cylindrical wall part 96 via the bearing 75. The housing 101 is closed by the top wall 73 and by the lower ring-shaped support 95. The connector terminals 60,62 project through the housing wall in a liquid-tight manner.

Figure 10:
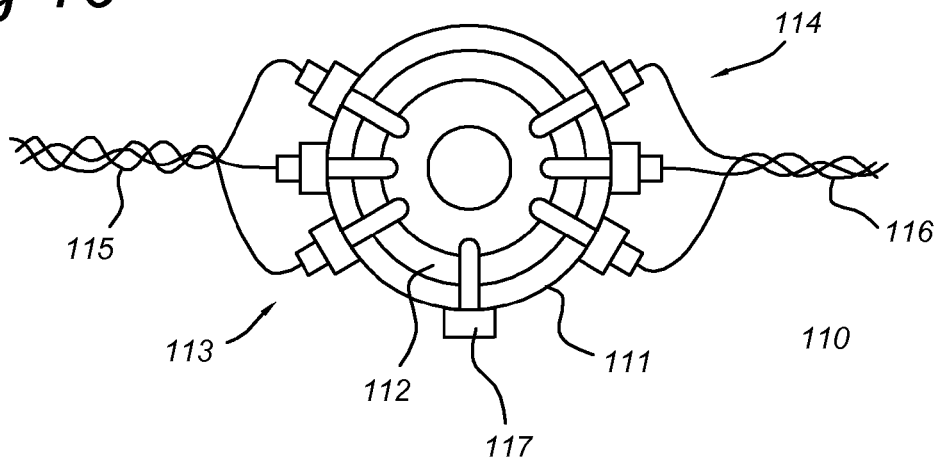
FIG. 10 shows a schematic top plan view of the swivel of FIG. 8 showing the grouped arrangement of the swivel connector terminals.

FIG. 10 shows a top plan view of a swivel 110 with outer conductor stack 111 and inner conductor stack 112. The connector terminals are arranged in two groups 113, 114 of three connector terminals each, each connector terminal in a group being attached to a conductor element with a different phase. The power cables 115, 116 attached to respective connecter terminals in a group of connector terminals 113, 114 are intertwined such that losses in the power cables 115, 116 due to the electrical fields generated by the currents in these cables are reduced. The connector terminal 117 for connecting to ground voltage is placed at a circumferential distance from the groups 113, 114.

Figure 11:
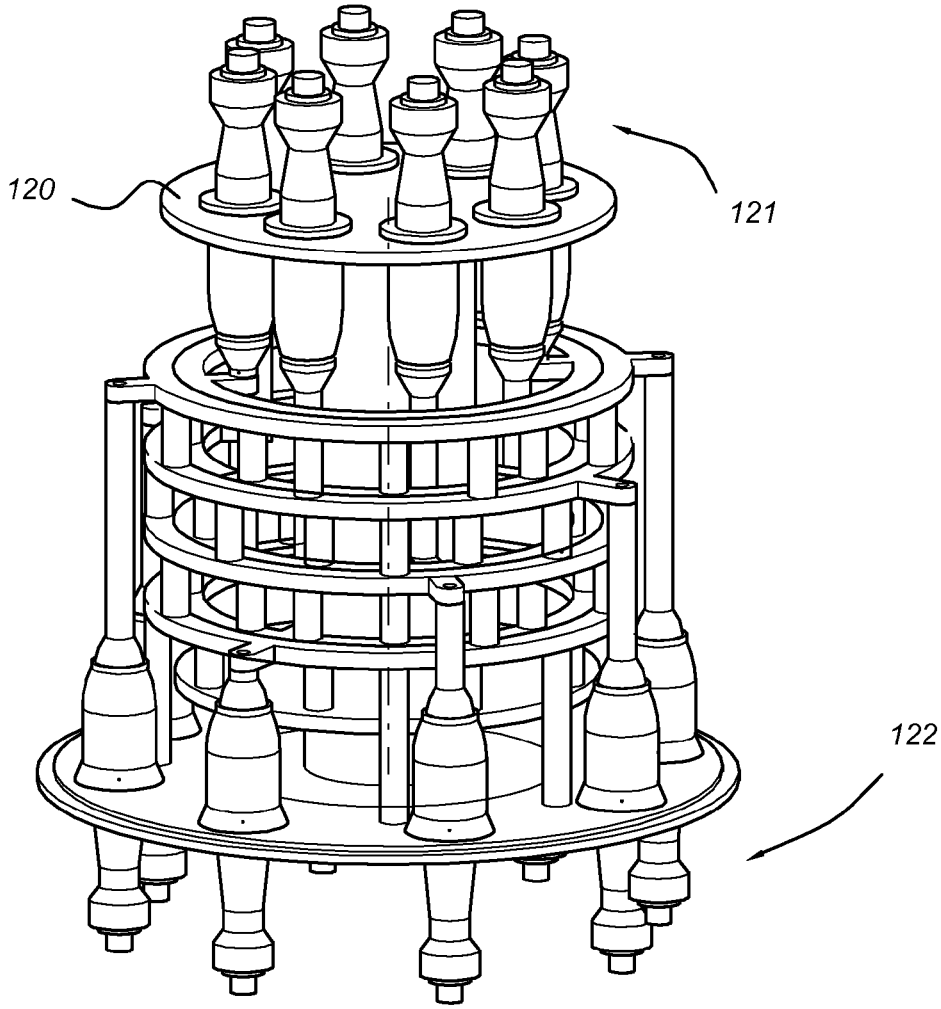
FIG. 11 shows a perspective view of a third embodiment of a high voltage swivel with all connector terminals in an axially oriented configuration.

FIG. 11 shows an embodiment wherein the connector terminals at the top end of the swivel are mounted in a horizontal support flange 120, such that both upper connector terminals 121, and lower connector terminals 122 extend in an axial direction.

Figure 12:
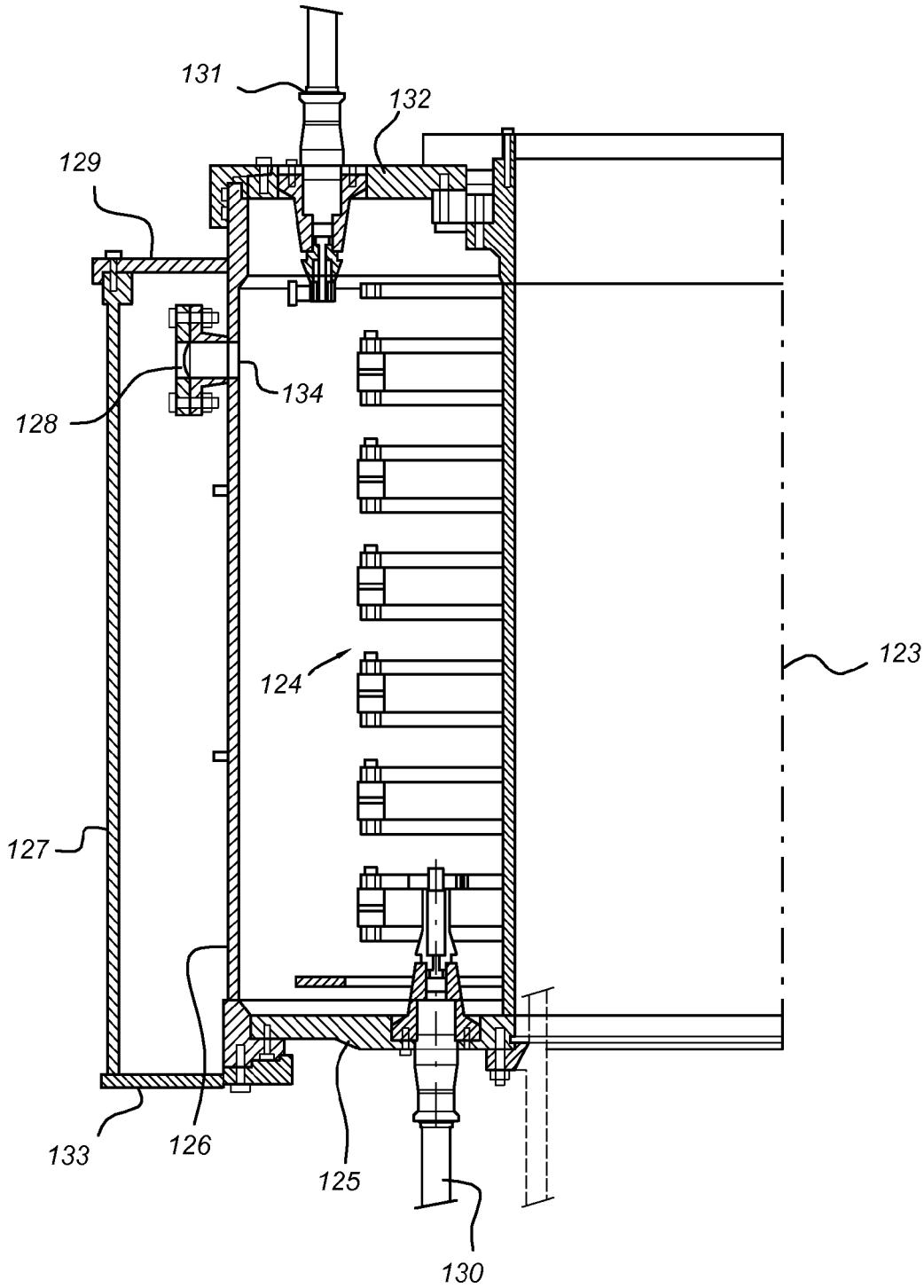
FIG. 12 shows an embodiment of a high voltage swivel having an inner housing and an outer containment housing.

FIG. 12 shows a swivel symmetrical around longitudinal axis 123, having an outer housing around the stacked conductors 124, with a cylindrical wall 126 a bottom wall 125 and a top wall 132. Connector terminals 130, 131 are attached to the top wall 132 and bottom wall 125. A second wall 127 with bottom 133 and top 129 is placed around the inner wall 126. No oil is present in the space defined between the walls 126 and 127. In the wall 126, a number of apertures 134 are provided that are closed off by a burst disc 128 which breaks away upon a pressure increase in the space defined by the wall 126. When, due to a short circuit, the pressure rises sharply in the space within inner wall 126, the burst disc 128 will break away from the aperture 134 such that oil can flow into the space between the inner wall 126 and the outer wall 127. Hereby the risk of projection of hot oil from the swivel containment and ejection of explosive gases from the swivel is sharply reduced and operational safety of the swivel is increased.

Figure 13:
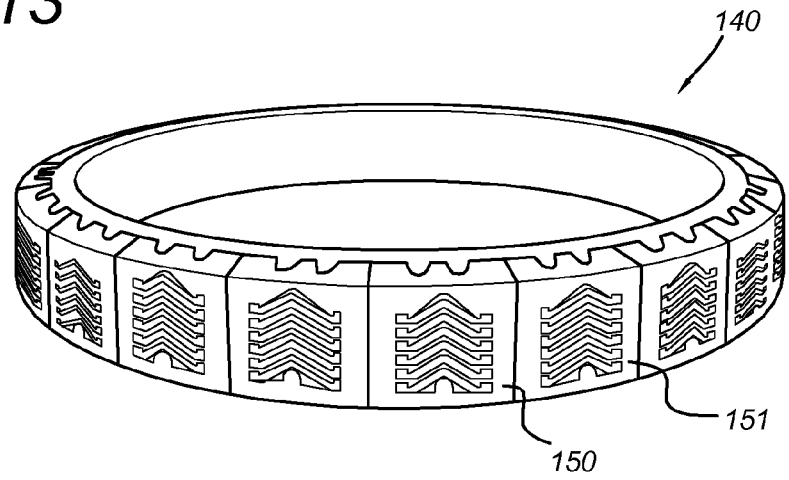
FIG. 13 shows an inner ring-shaped conductor element comprising a number of spring plates mounted in mounting frames, attached to the contact surface.
Figure 14:
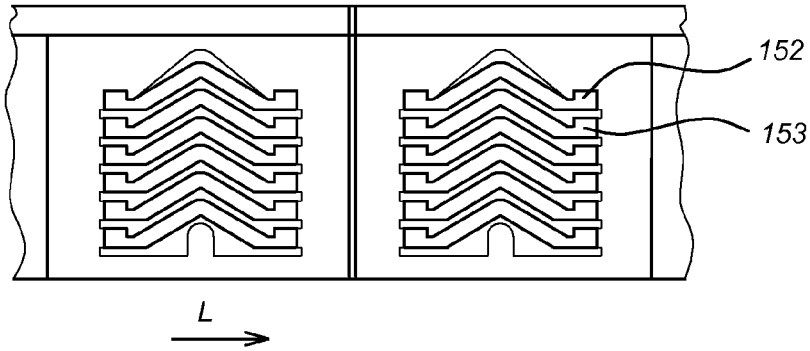
FIG. 14 shows a detail of the mounting plate carrying louver-type spring plates according to FIG. 13.

FIG. 13 shows an inner ring-shaped conductor element 140 which at its contact surface is provided with a number of mounting frames 150, 151, each mounting frame carrying six spring plates 152,153 in a louver like configuration, as can be seen from FIG. 14. The spring plates compensate for the mechanical tolerances between the rigid inner and outer ring-shaped conductor elements and provide a secure conducting contact between the conductor elements at all times. The spring plates extend generally with their length direction L in the circumferential direction of the conductor elements, such that upon rotation an even force distribution for rotations in either direction is obtained, reduced wear of the spring plates occurs and a good conductive contact is established with the outer conductor element 141.

Figure 15:
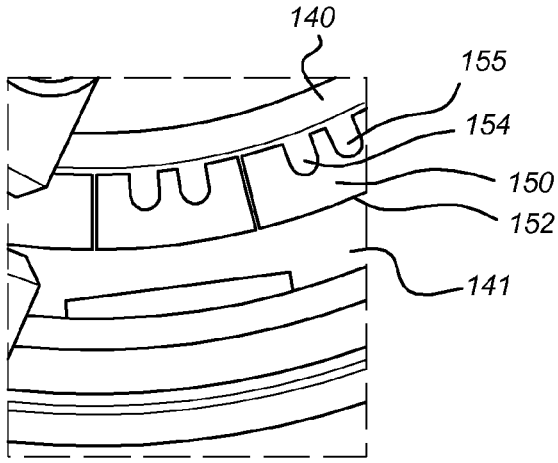
FIG. 15 shows a top view of the inner conductor element, the spring plates and the outer conductor element, and FIG. 16 schematically shows an offshore system with a floating power plant comprising a high voltage swivel of the present invention.

As can be seen from FIG. 15, the mounting frames 150, 151 are at their rear side provided with grooves, into which projections 154, 155 on the peripheral surface of the conductor element 140 fit. In the embodiment that is shown, the conductor member 140 is covered along its complete circumference by the mounting frames 150, 15 which can be easily replaced in case of damage to the spring plates. It is however also possible to cover only part of the circumference of the conductor element with spring plates, by placing the mounting frames 150, 151 at a relatively large mutual distance.

Figure 16:
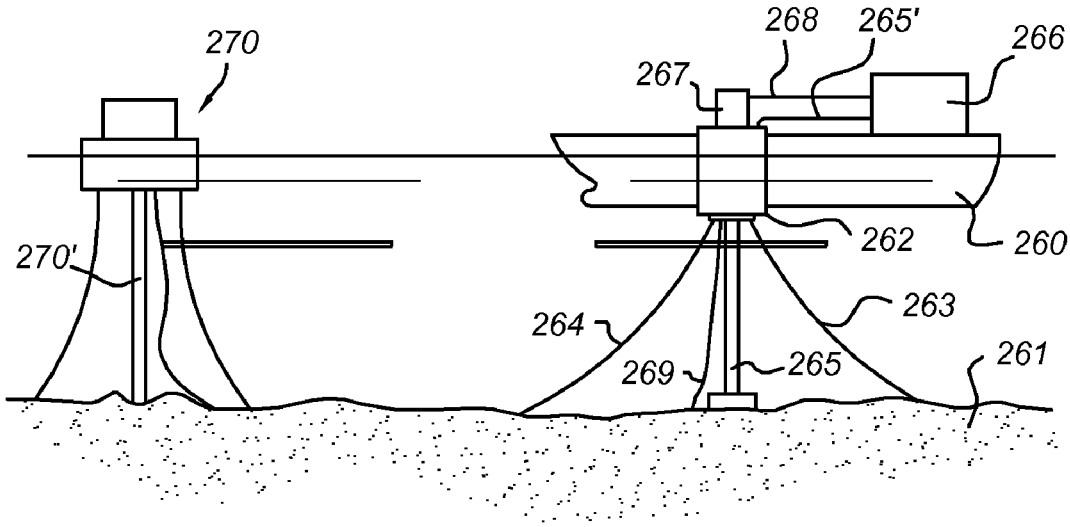

FIG. 16 shows an offshore system comprising a Floating Production, Storage and Offloading vessel (FPSO) 260 which is anchored to the sea bed 261 via a turret 262, at the bottom of which anchor lines 263 and 264 are attached. The vessel 260 can weathervane around the turret 262, which is geostationary. A product riser 265 extends from a sub sea hydrocarbon well to a product swivel (not shown) on the FPSO 260 and from the product swivel via a duct 65' to production and/or processing equipment on the FPSO. In a power generation unit 266, gas produced from the well is converted into electricity which is supplied to a swivel 267 according to the present invention. The power lead 268 extending from the power generation unit 266 is attached to conductors on the outer element of the swivel which is stationary relative to the vessel 260. The power lead 269, extending to the sea bed is connected to the electrical conductors of the inner element of the swivel 267 which is fixedly attached to the turret 262. The power lead 269 may extend to an unmanned platform 270 attached to the sea bed via product riser 270', such as a gas riser, or may extend to an on-shore power grid 71, or may be connected to heating elements 275, 276 of a substantially horizontal hydrocarbon transfer duct 277 between two floating structures 272, 273.

It should be noted that in stead of with an FPSO 260, the swivel according to the present invention can also be used with other offshore power generating constructions such as weathervaning wind turbines.

The invention claimed is:

1. A high voltage swivel, comprising:

an inner body; and an outer body, the inner and outer bodies being coaxial around a longitudinal axis and being rotatable relative to one another around the longitudinal axis, wherein each of the inner body and the outer body has at least a first and a second ring-shaped conductor element, the first and second conductor elements comprising two spaced-apart end faces and a curved contact surface, the first and second conductor elements being mutually interconnected at opposing end faces via insulating members at axially spaced-apart positions, each conductor element of the inner body and the outer body being connected to a voltage line extending to an input terminal or an output terminal, the curved contact surface of each inner conductor element is adjacent to and in electrical contact with an opposed contact surface of a corresponding outer conductor element, the insulator members interconnecting the conductor elements are situated at a mutual distance in the circumferential direction of the conductor element, and the interconnected conductor elements of the inner and the outer body form an open cage-like construction, each interconnected conductor element being supported by a respective support member to form integral units that are adapted to be mutually decoupled or attached by relative displacement of the integral units in the direction of the longitudinal axis.

2. The high voltage swivel according to claim 1, wherein the support member comprises a transverse flange extending substantially parallel to the ring-shaped conductor elements.

3. The high voltage swivel according to claim 2, wherein the inner body comprises, along the longitudinal axis, a core element carrying at a lower side the transverse flange, a lower conductor element of the inner body having a lower end face connected to the transverse flange via spaced-apart insulating members.

4. The high voltage swivel according to claim 1, wherein each conductor element of the inner body comprises at least one radially inwardly projecting conductor part attached to an inner axial conductor that extends inwardly of the ring-shaped conductor elements in an axial direction to an end part that is situated above or below a topmost or lowermost conductor element of the inner body, an end part of which is attached to a connector terminal.

5. The high voltage swivel according to claim 1, wherein each conductor element of the outer body comprises at least one radially outwardly projecting conductor part attached to an outer axial conductor that extends outwardly from the ring-shaped conductor elements in an axial direction to an end part above or below a topmost or lowermost conductor element of the outer body, an end part of which is attached to a connector terminal.

6. The high voltage swivel according to claim 4, wherein the connector terminals of the inner and outer bodies are situated at opposite end parts of the axial conductors.

7. The high voltage swivel according to claim 2, wherein the connector terminals of one or more of the inner body and the outer body are axially directed and attached along a circular contour on a radial flange.

8. The high voltage swivel according to claim 2, wherein the connector terminals of one or more of the inner body and the outer body are radially directed and attached along a contour of a ring-shaped support.

9. The high voltage swivel according to claim 7, wherein the radial flange of the inner body or outer body is connected to a lower cylindrical housing part, a ring-shaped support of the outer body being attached via a rotatable bearing to the lower housing part and to a cover to form a liquid-tight enclosure around the conductor elements.

10. The high voltage swivel according to claim 6, wherein the inner and outer bodies are attached to a top cover and to a bottom cover, respectively, the top and bottom covers being interconnected via an inner cylindrical wall, one of the covers being rotatable relative to the cylindrical wall around the longitudinal axis, an outer cylindrical wall surrounding the inner cylindrical wall, the inner cylindrical wall being provided with apertures and seals that are adapted to open the apertures when a predetermined pressure on the seal is exceeded.

11. The high voltage swivel according to claim 1, wherein the conductor elements of the inner body and the outer body are each connected to a transverse bottom flange and a top flange via an axially extending insulator extending from a flange, through axially aligned holes in the ring-shaped conductor elements and through a first insulating spacer member situated between the top flange and a topmost ring-shaped conductor element, a second insulating spacer member being situated between the at least two ring-shaped conductor elements, and a third insulating spacer member being situated between the bottom flange and a lowermost ring-shaped conductor element.

12. The high voltage swivel according to claim 1, wherein spring plates are fixed to the conductor element at the contact surface of the inner or the outer conductor element, arranged side by side, a length direction of the spring plates extending in the circumferential direction of the conductor element at the contact surface.

13. The high voltage swivel according to claim 12, wherein the spring plates have a length that is smaller than 0.1 times a circumferential length of the contact surface of the conductor element.

14. The high voltage swivel according to claim 12, wherein the spring plates are mounted in a mounting frame, one of the conductor elements having at or near the contact surface a coupling member configured to engage with the mounting frame, a plurality of mounting frames being situated on the contact surface of the conductor element.

15. The high voltage swivel according to claim 14, wherein a plurality of adjacent mounting frames substantially cover the contact surface of the conductor element.

16. A mounting frame comprising a plurality of spring plates for use in the high voltage swivel according to claim 14.

17. The high voltage swivel according to claim 8, wherein the radial flange of the inner body or the outer body is connected to a lower cylindrical housing part, the ring-shaped support of the outer body being attached via a rotatable bearing to the lower housing part and to a cover to form a liquid-tight enclosure around the conductor elements.

18. A high voltage swivel comprising:

an inner body; and an outer body, the inner and outer bodies being coaxial around a longitudinal axis and being rotatable relative to one another around the longitudinal axis, the inner body and the outer body being attached to a top cover and bottom cover, respectively, the covers being interconnected via a first cylindrical wall provided with apertures and seals that are adapted to open the apertures when a predetermined pressure on the seals is exceeded, one of the covers being rotatable relative to the first cylindrical wall around the longitudinal axis, an outer cylindrical wall surrounding the first cylindrical wall, wherein each of the inner body and the outer body has at least a first and a second ring-shaped conductor element, the first and second conductor elements comprising two spaced-apart end faces and a curved contact surface, the conductor elements being mutually interconnected at opposing end faces via insulating members at axially spaced-apart positions, the interconnected conductor elements forming an open cage-line construction, the curved contact surface of each inner conductor element is adjacent to and in electrical contact with an opposed contact surface of a corresponding outer conductor element, and each conductor element of the inner body and the outer body is connected to a voltage line extending to an input terminal or to an output terminal.

19. The high voltage swivel according to claim 18, wherein each interconnected conductor element is supported by a respective support member to form integral units that are adapted to be mutually decoupled or attached by relative displacement of the integral units in the direction of the longitudinal axis.

20. A high voltage swivel comprising:

an inner body; and an outer body, the inner and outer bodies being coaxial around a longitudinal axis, the inner and outer bodies being rotatable relative to one another around the longitudinal axis, wherein each of the inner body and the outer body has at least a first and a second ring-shaped conductor element, the conductor elements comprising two spaced-apart end faces and a curved contact surface, the conductor elements being mutually interconnected at opposing end faces via insulating members at axially spaced-apart positions, the interconnected conductor elements forming an open cage-line construction, the contact surface of each inner conductor element is adjacent to and in electrical contact with an opposed contact surface of a corresponding outer conductor element, and each conductor element of the inner body and the outer body is connected to a voltage line extending to an input terminal or to an output terminal, springs plates being fixed to the conductor element at the contact surface of the inner or outer conductor element, arranged side by side, a length direction of the spring plates extending in the circumferential direction of the conductor element.

* * * * *